US007188551B2

(12) United States Patent
Choi

(10) Patent No.: US 7,188,551 B2
(45) Date of Patent: Mar. 13, 2007

(54) SPANNER

(76) Inventor: Ock-Soon Choi, Shindoo-Ri, 18-7, Yipjang-Myeon, Cheonan-Shi 330-826 (KR)

( * ) Notice: Subject to any disclaimer, the term of this patent is extended or adjusted under 35 U.S.C. 154(b) by 0 days.

(21) Appl. No.: 10/530,796

(22) PCT Filed: Oct. 10, 2003

(86) PCT No.: PCT/KR03/02091

§ 371 (c)(1),
(2), (4) Date: Nov. 30, 2005

(87) PCT Pub. No.: WO2004/033156

PCT Pub. Date: Apr. 22, 2004

(65) Prior Publication Data

US 2006/0144197 A1 Jul. 6, 2006

(30) Foreign Application Priority Data

Oct. 10, 2002 (KR) ..... 20-2002-0030200
Jan. 7, 2003 (KR) ..... 20-2003-0000387

(51) Int. Cl.
*B25B 13/28* (2006.01)

(52) U.S. Cl. ..... 81/98; 81/90.1; 81/91.3; 81/103

(58) Field of Classification Search ..... 81/90.1, 81/91.3, 98, 103
See application file for complete search history.

(56) References Cited

U.S. PATENT DOCUMENTS 2,537,838 A * 1/1951 Logan ..... 81/90.2
3,044,335 A * 7/1962 Keranen ..... 81/90.1
4,893,528 A 1/1990 Chung-Hsing
5,148,725 A 9/1992 Botha

FOREIGN PATENT DOCUMENTS

JP 7-164336 A 6/1995

OTHER PUBLICATIONS

Patent Abstracts of Japan, No. 07-164336, Jun. 27, 1995, 1 page.
Patent Abstracts of Japan, No. 2000-334668, Dec. 5, 2000, 1 page.

* cited by examiner

*Primary Examiner*—Joseph J. Hail, III
*Assistant Examiner*—Shantese McDonald
(74) *Attorney, Agent, or Firm*—MacPherson Kwok Chen & Heid LLP

(57) ABSTRACT

Disclosed is a spanner which is generally used as a typical tool for tightening or releasing a bolt. The spanner is capable of tightening or releasing a bolt continually in one direction by the effect of a toggle bar (400) pivotally mounted on a jaw of two jaws (200, 300) of the spanner head in a state that the toggle bar is urged to pivot toward one direction. A protrusion (30, 32) is formed on a distal end of the other jaw of the spanner head for gripping an angular portion of the bolt head so that it is possible to prevent the spanner head being readily disengaged from the bold head.

6 Claims, 9 Drawing Sheets

SPANNER

BACKGROUND OF THE INVENTION

1. Field of the invention

The present invention relates to a spanner generally used as a typical tool for tightening or releasing a hexagonal headed bolt or nut, more particularly to a spanner capable of tightening or releasing a bolt continually in one direction by the effect of a toggle bar pivotally mounted on a jaw of two jaws of the spanner head in a state that the toggle bar is urged to pivot toward one direction.

According to the present invention, if a user turns the spanner in clockwise direction, the rotating force of the spanner is applied to the bolt head so that the bolt head is tightened or released by the spanner, whereas, if a user turns the spanner in counter clockwise direction, the toggle bar is swung upwardly to be idle from the bolt head so that the rotating force of the spanner is not applied to the bolt head, thereby the spanner is capable of tightening or releasing a bolt continually in one direction while maintaining the hexagonal head of the bolt within the spanner head.

2. Description of the Related Art

A spanner generally used for tightening or releasing a hexagonal headed bolt or nut includes a lever provided with two jaws on an end, and each jaw has opposite surface parallel to each other for receiving a bolt or nut therebetween to rotate it. As typical types of a generally used spanner, there are a fixed type spanner having two jaws spaced apart from each other with a fixed distance, and an adjustable type spanner having a fixed jaw and a movable jaw capable of moving toward or away from the fixed jaw.

Another typical type of a generally used tool for tightening or releasing a bolt or a nut is a box wrench. A box wrench having a ratchet mechanism is also broadly used, which is constructed that the rotating force of the ratchet box wrench is applied to the bolt head so as to be tightened or released when turning the ratchet box wrench only in a predetermined direction of clockwise or counter clockwise direction thereby being capable of tightening or releasing a bolt continually in one direction.

In operations for tightening or releasing a bolt, a user determines which one is better between a spanner or a box wrench in consideration of the working conditions, such as working space for operation of the tool or location of bolt or nut fastened, etc., and uses the selected tool. In case of using a box wrench, especially a ratchet box wrench, it is possible to tighten or release a bolt continually in one direction while maintaining a state that the bolt or nut is inserted within the head of the box wrench, and which would increase the working efficiency.

However, certain working conditions require only a spanner. Being different from a ratchet box wrench, a conventional spanner is not capable of tightening or releasing a bolt continually in one direction, therefore, a user has to insert a bolt head within the head of the spanner to be engaged with the bolt head repeatedly each time after turning the spanner at a predetermined angle, for example 60 degrees for tightening or releasing a bolt or nut, and which would decrease the working efficiency.

In relation to this problem, there have been some attempts to provide a spanner having a ratchet mechanism capable of tightening or releasing a bolt continually in one direction, such as Korean Patent Laying-Open Publication No. 2000-0000449, Korean Patent Laying-Open Publication No. 1999-0028347, Korean Utility Model Reg. Publication No. 20-0243241, and Korean Utility Model Reg. Publication No. 20-0261440. However, these spanners have a problem that the construction of the spanner head become complex since a ratchet mechanism itself has a complex construction, accordingly the volume of the spanner head becomes too large, which makes the spanner loose its own merit of being convenient for operation in a slim working space.

Therefore, it is requested to develop a new spanner capable of tightening or releasing a bolt continually in one direction while maintaining its own merit of being convenient for operation in a slim working space.

In the mean time, the conventional spanner has another problem that respective distal ends of two jaws are opened parallel to each other so that the spanner is readily disengaged from the bolt head during operation, and this is quite inconvenient especially when a user holds the spanner vertically during operation for tightening or releasing a bolt or nut since he has to urge the spanner upwardly in order for turning the spanner. Therefore, it is requested to develop an improved spanner which further includes a protrusion disposed on a distal end of at least one jaw for gripping a bolt head, preferably an angular portion of a bolt head thereby the spanner is capable of maintaining the state that the bolt head is inserted therein even though a user takes his hand off the spanner when he holds the spanner vertically during operation for tightening or releasing a bolt or nut. The present invention has been made to fulfill above two requests.

DETAILED DESCRIPTION OF THE INVENTION

In order to fulfill above requests, the present invention is constructed to have following features. According to a feature of the present invention, a spanner comprises;

a lever, a first jaw extending from an end of the lever, a second jaw spaced from the first jaw in a predetermined distance to form a pair of jaws and having a recess therein, a toggle bar pivotally mounted in the recess by a pivot pin and having an inner end portion and an outer end portion, and an urging member having one end supported in an inner wall of the recess and the other end supporting a bottom surface of the outer end portion of the toggle bar for urging the toggle bar to pivot toward its inner end portion.

According to another feature of the present invention, a spanner further comprises an adjustable stopper for adjusting the limit of pivoting angle of the toggle bar which is urged to pivot toward its inner end portion.

According to another feature of the present invention, the spanner further comprises a protrusion detachably or fixedly disposed on a distal end of the first jaw for gripping an angular portion of the bolt head.

According to another feature of the present invention, a spanner comprises;

a lever, a first jaw extending from an end of the lever and having a first recess therein, a first toggle bar pivotally mounted in the first recess by a pivot pin and having an inner end portion and an outer end portion, a first urging member having one end supported by a wall of the first recess and the other end supporting a bottom surface of the outer end portion of the first toggle bar for urging the first toggle bar to pivot toward its inner end portion, a second jaw spaced from the first jaw in a predetermined distance to form a pair of jaws and having a second recess therein, a second toggle bar pivotally mounted in the second recess by a pivot pin and having an inner end portion and an outer end portion, and a second urging member having one end supported by a wall of the second recess and the other end supporting a bottom surface of the outer end portion of the second toggle bar for urging the second toggle bar to pivot toward its inner end portion.

According to another feature of the present invention, the longitudinal axis of the lever is disposed to define an angle with respect to the longitudinal axis of two jaws in a range from 90 to 180 degrees.

BRIEF DESCRIPTION OF THE DRAWINGS

The above objects, and other features and advantages of the present invention will become more apparent after reading of the following detailed description when taken in conjunction with the drawings, in which.

PREFERRED EMBODIMENTS OF THE INVENTION

Figure 1:
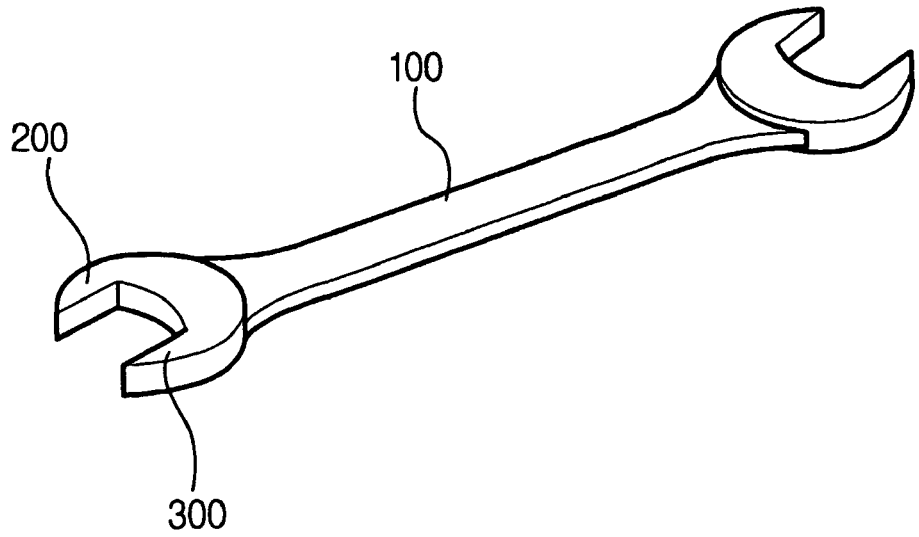
FIG. 1 is a perspective view illustrating a conventional spanner in general.
Figure 2:
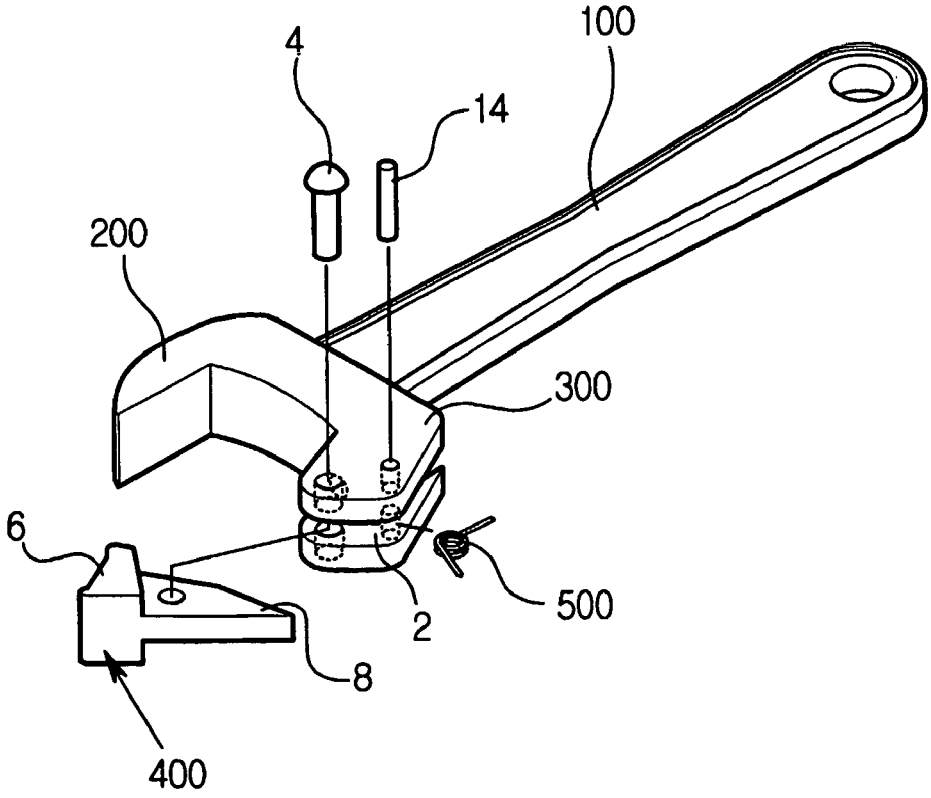
FIG. 2 is an exploded perspective view illustrating a spanner according to the first embodiment of the present invention.

As shown in FIG. 1, a conventional spanner generally includes a lever (100) extending in a longitudinal direction of the spanner and a pair of jaws (200, 300) disposed on at least one end of the lever for receiving a bolt head therebetween. The detailed explanation about the operations and functions of the conventional spanner will not be necessary since it is well known to the public.

In FIGS. 2 to 6, a spanner according to a first embodiment of the present invention is shown. As shown in these drawings, the spanner comprises a lever (100), a first jaw (200) extending substantially longitudinally from an end of the lever, a second jaw (300) spaced from the first jaw in a predetermined distance to form a pair of jaws and having a recess (2) therein, a toggle bar (400) pivotally mounted in the recess by a pivot pin (4) and having an inner end portion (6) and an outer end portion (8), and an urging member (500) having one end supported by a bottom wall (indicated by numeral 10 in FIG. 4) of the recess and the other end supporting a bottom surface of the outer end portion (8) of the toggle bar for urging the toggle bar to pivot toward its inner end portion (as indicated by arrow A2 in FIG. 4).

As a urging member (500) in the first embodiment, a coil spring is disclosed for exemplarily illustrating urging operation of the toggle bar, however, the urging member will not be limited thereto. Although not shown, various types of urging member, for examples, plate spring, ball spring, and plunger spring etc. may be adapted within the scope of the invention if it is capable of urging the bottom surface of the outer end portion of the toggle bar to pivot toward its inner end portion about the pivot pin (4). Unexplained reference numeral 14 indicates a fixing pin for fixing the coil spring in the recess (2).

Figure 3:
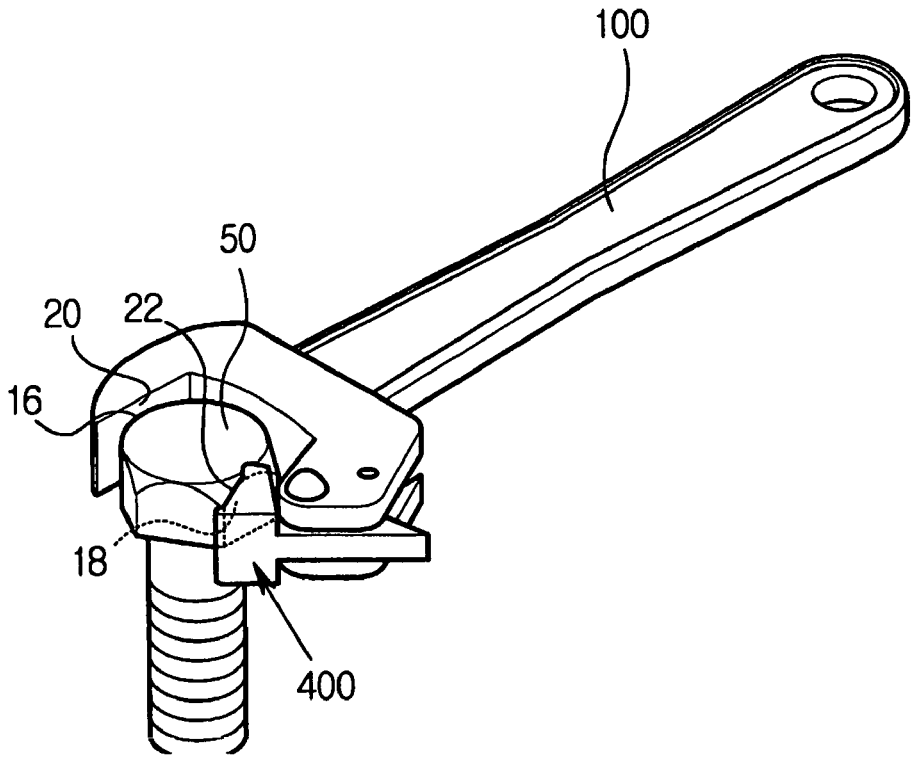
FIG. 3 is a perspective view illustrating a state that a bolt head is inserted within the spanner according to the first embodiment of the present invention.
Figure 4:
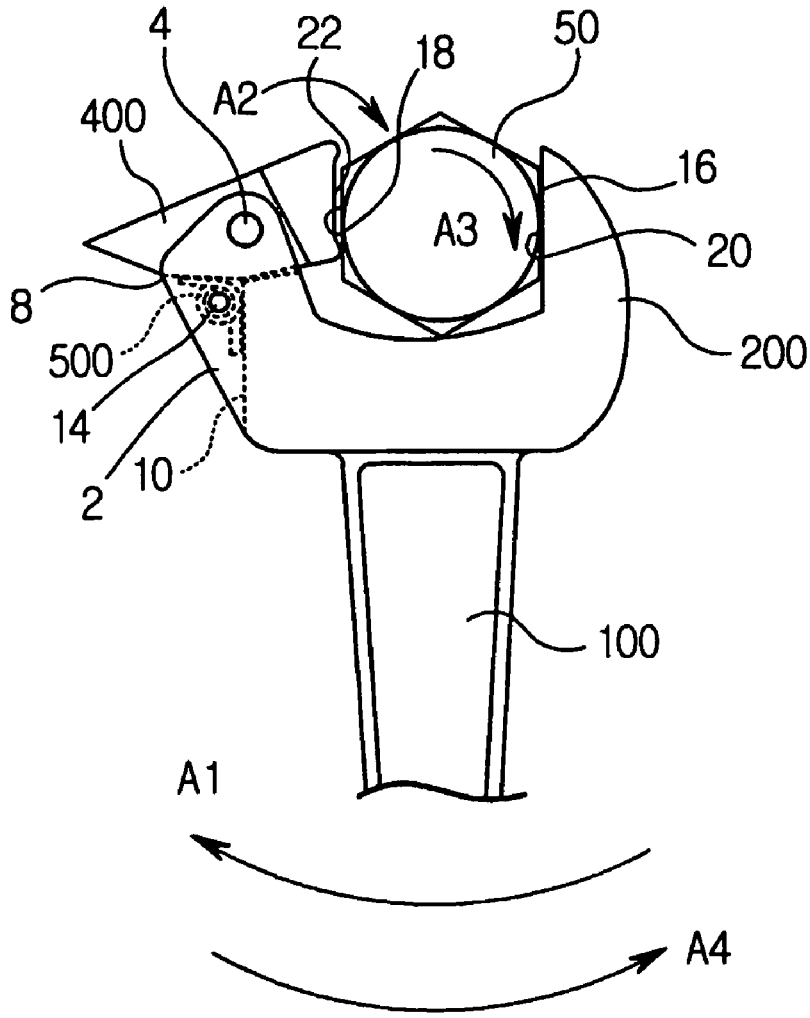
FIG. 4 is a fragmentary plan view illustrating the spanner according to the first embodiment of the present invention.

As can be seen in FIGS. 3 and 4, when a bolt head (50) is inserted within the spanner according to the first embodiment, two surfaces of the spanner being in abutment with the opposite surfaces (16, 18) of the bolt head and applying forces thereto are respectively an inner surface (20) of the first jaw and a side surface (22) of the inner end portion of the toggle bar. In the spanner of the present invention, the first jaw (200) and the toggle bar (400) function as a pair of jaws of the conventional spanner, and the second jaw (300) of the present invention functions only as a base member for pivotally supporting the toggle bar (400).

Figure 5:
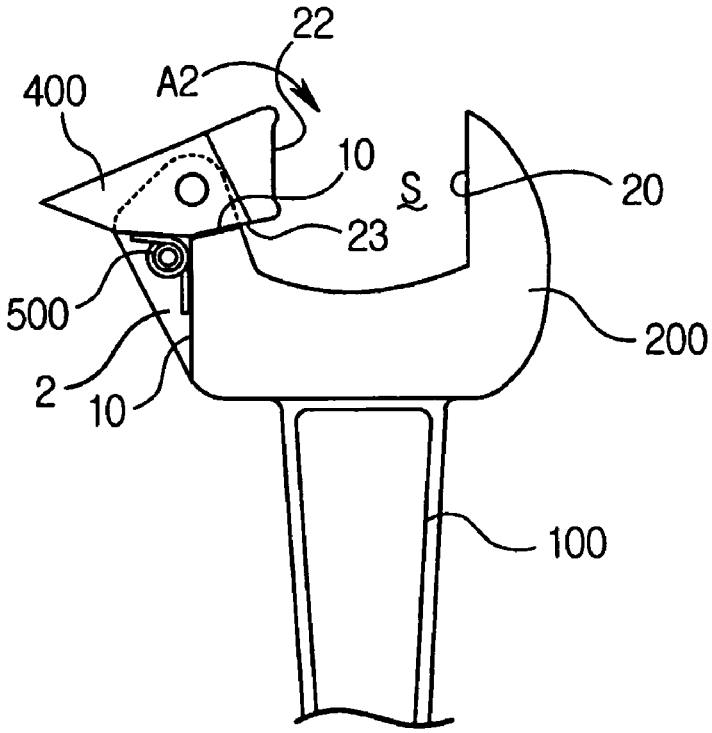
FIG. 5 is a fragmentary plan view illustrating locations of the toggle bar and the recess formed on the second jaw of the spanner according to the first embodiment of the present invention.

As can be seen in FIG. 5, the toggle bar in a free condition that the bolt head is not inserted within the spanner and is urged to pivot in clockwise direction (as indicated by arrow A2) due to the elasticity of the coil spring (500), is limited not to pivot any further in clockwise direction when being in contact with the bottom wall (10) of the recess. In this state, the inner surface (20) of the first jaw (200) is substantially parallel with the side surface (22) of the inner end portion of the toggle bar, and above two surfaces (20) (22) define a space (S) therebetween for receiving the bolt head.

Figure 6:
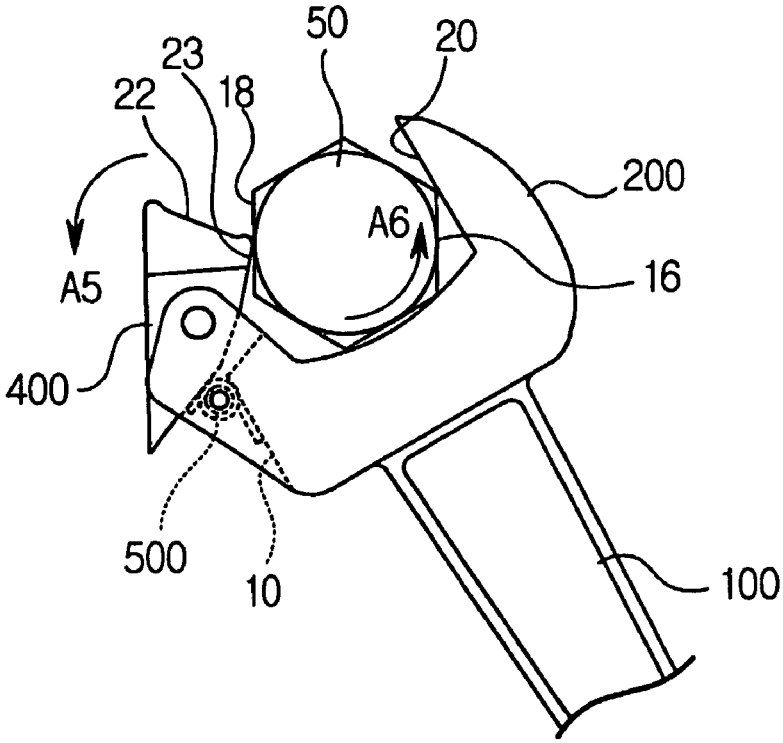
FIG. 6 is a fragmentary plan view illustrating a state that the toggle bar of the spanner is swung upwardly in counter clockwise direction (as indicated by arrow A5 in FIG. 6) and just in contact with a bolt head, when the spanner is turned in counter clockwise direction (as indicated by arrow A4 in FIG. 4) which is a direction for a bolt to be released.

Referring to FIGS. 4 to 6, a function for applying rotating forcing in one direction according to the present invention now will be described as following.

When turning the lever (100) of the spanner in a direction of arrow A1 of FIG. 4 (clockwise direction in the drawing) in order to tighten a bolt head (50), the surface (18) of the bolt head positioned near the toggle bar gets in abutment with the side surface (22) of the inner end portion of the toggle bar and apply force to the toggle bar (400) to pivot in clockwise direction (in a direction of arrow A2 in the drawing), however, the toggle bar is limited not to pivot any further in clockwise direction as can be seen in FIG. 5, so that the side surface (22) of the inner end portion of the toggle bar acts as a forcing member for applying force to the surface (18) of the bolt head so as that the bolt is tightened in a direction of arrow A3 in FIG. 4.

However, when turning the lever (100) of the spanner in the direction of arrow A4 in FIG. 4 (counter clockwise direction in the drawing), the surface (18) of the bolt head pushes up the bottom surface (23) of the inner end portion of the toggle bar, then the toggle bar swings upwardly in counter clockwise direction (in a direction of arrow A5 in FIG. 6) while forcing the spring (500) to be compressed as can be seen in FIG. 6. During a state that the toggle bar is swung upwardly in a direction of arrow A5, the inner end portion of the toggle bar does not apply any force to the bolt head and is just in contact with the surface (18) of the bolt head, so that the bolt (50) can maintain its state and does not rotate in a direction of arrow A6 (in counter clockwise direction) irrelatively to turning of the lever in counter clockwise direction, thereby the spanner functions as a tool capable of tightening a bolt continually in one direction.

Figure 7:
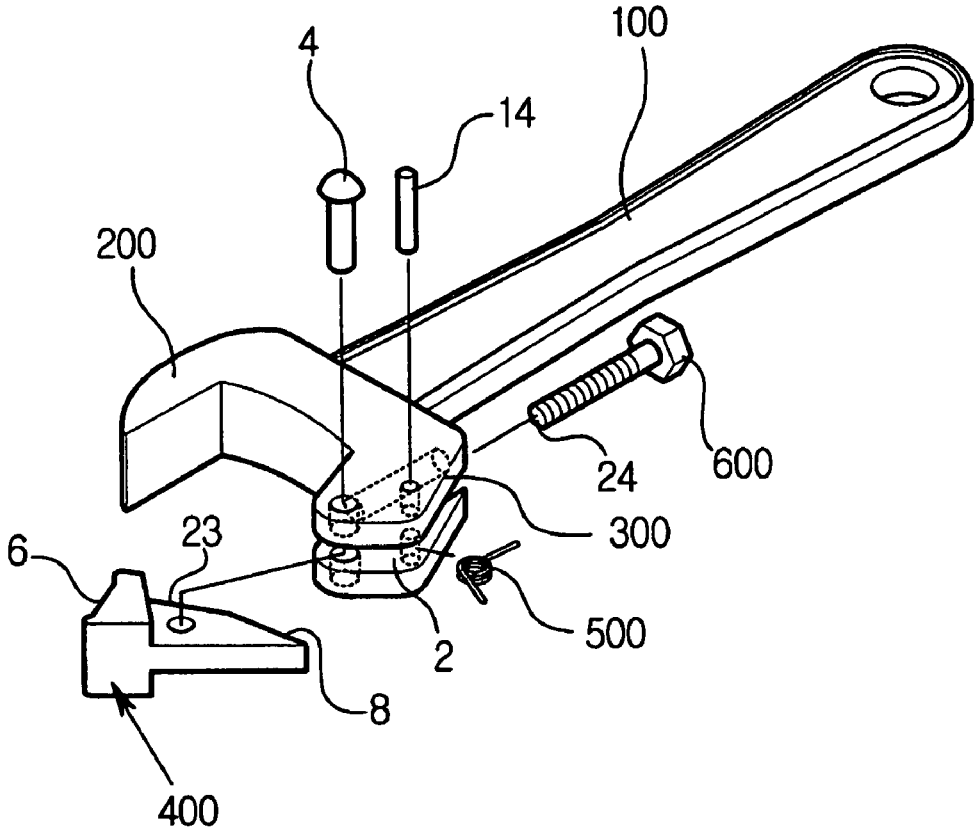
FIG. 7 is an exploded perspective view illustrating a spanner according to a second embodiment of the present invention.
Figure 9:
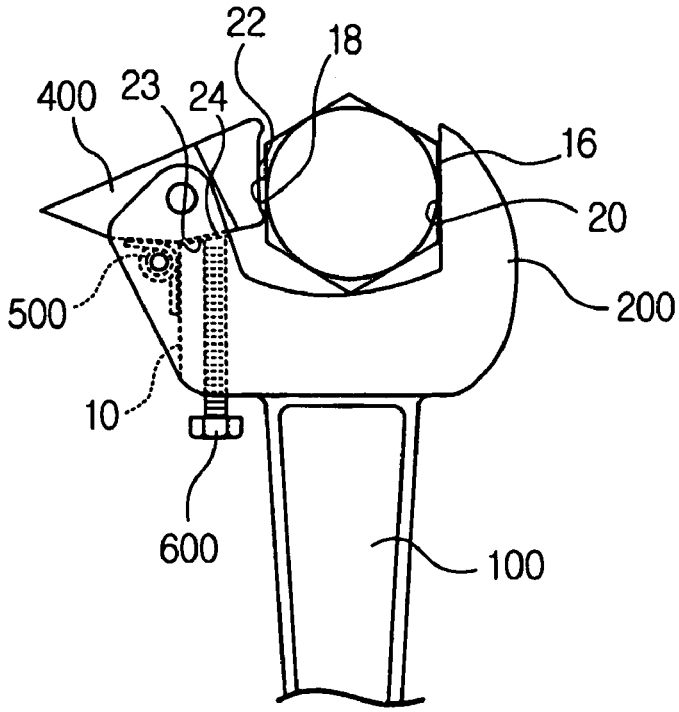
FIG. 9 is a fragmentary plan view illustrating the spanner according to the second embodiment of the present invention.

FIG. 7 is an exploded perspective view illustrating a spanner according to a second embodiment of the present invention, and FIG. 9 is a fragmentary plan view thereof. As can be seen in these drawings, the second embodiment additionally has a function of optionally adjusting the limit of pivoting angle of the toggle bar (400) being urged to pivot in clockwise direction. For this purpose, the spanner of the second embodiment further includes a screw (600) mounted on the second jaw (300) passing through the body of the second jaw so that an end (24) of the screw is substantially perpendicularity in contact with the bottom surface (23) of the inner end portion of the toggle bar.

According to this embodiment, it is possible to adjust the initial setting angle of the toggle bar on its free condition by virtue of the degrees of advance or withdrawal of the screw (600). When the screw raises up the toggle bar in order to adjust the initial setting angle of the toggle bar on its free condition, the critical value of force required to swing the toggle bar upwardly in counter clockwise direction is decreased. This construction has advantages that it makes tightening or releasing a bolt continually in one direction more softly and smoothly.

Figure 8:
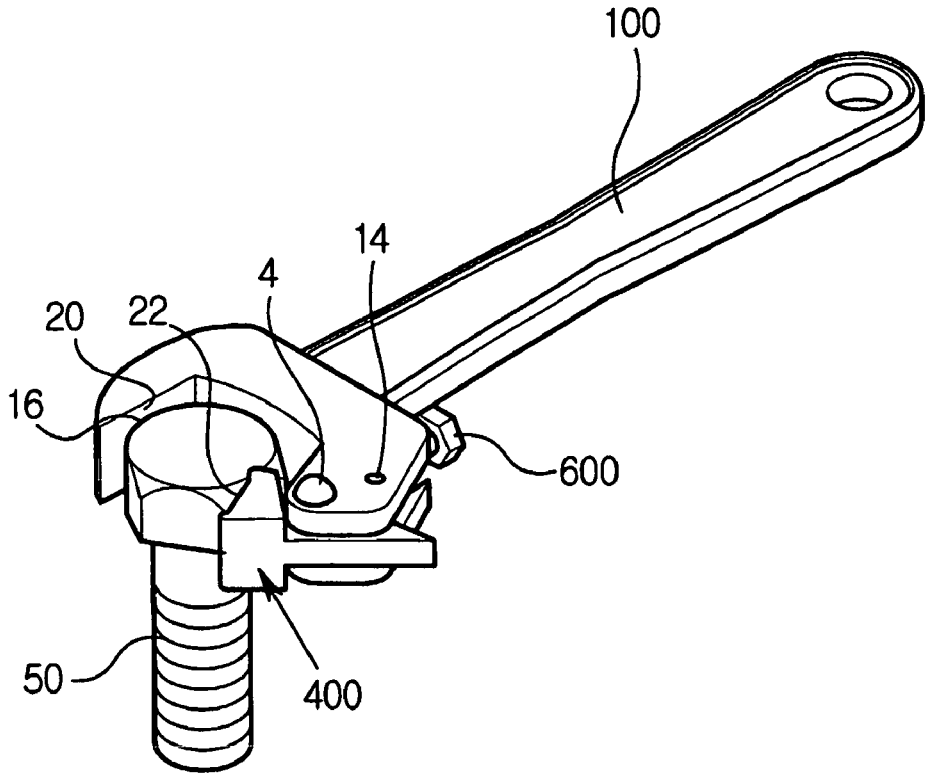
FIG. 8 is a perspective view illustrating a state that a bolt head is inserted within the spanner according to the second embodiment of the present invention.

FIG. 8 is a perspective view illustrating a state that the bolt head is inserted within the spanner according to the second embodiment aforementioned.

Figure 10:
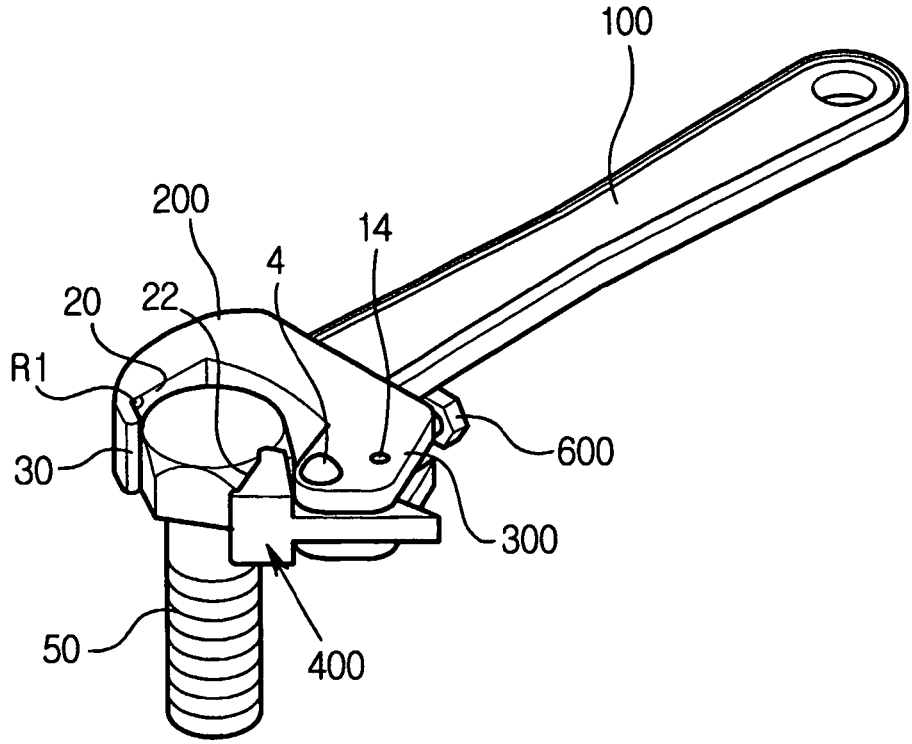
FIG. 10 is a perspective view illustrating a state that a bolt head is inserted within a spanner according to a third embodiment of the present invention.

FIG. 10 is a perspective view illustrating a spanner according to a third embodiment of the invention. This embodiment has a feature different from the second embodiment aforementioned in that it further includes a protrusion (30) disposed on a distal end of the first jaw (200) and protruding toward the second jaw (300).

This protrusion (30) aims to solve the defect of the conventional spanner being readily disengaged from the bolt head since each distal end of two jaws is opened parallel to each other. This embodiment is especially effective when a user holds the spanner vertically in operation since he need not urge the spanner upwardly while turning it. If a user takes his hand off the spanner when he holds the spanner vertically in operation for tightening or releasing a bolt, the protrusion is hung on the bolt head thereby it is possible to maintain a state that the bolt head is within the spanner head. In relation to this function, the protrusion (30) is disposed to define an angle (R1) with respect to the inner surface (20) of the first jaw preferably at 120 degrees which is exactly fit to an angular portion of the bolt head. And it is apparent that the protrusion (30) for gripping a bolt head is applicable to the aforementioned first and second embodiments.

Figure 11:
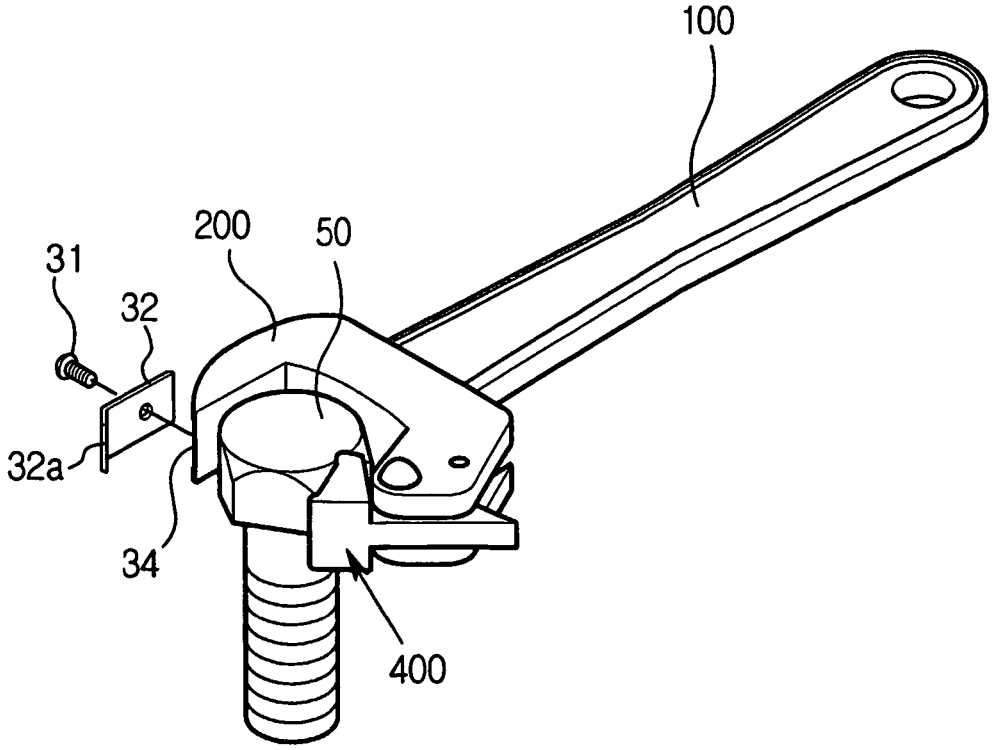
FIG. 11 is a fragmentary exploded perspective view illustrating a spanner according to a fourth embodiment of the present invention.
Figure 12:
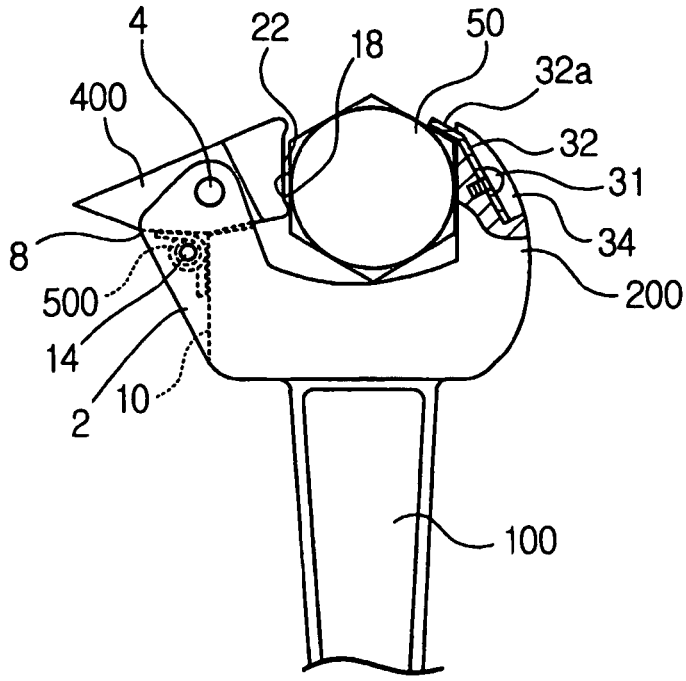
FIG. 12 is a fragmentary plan view illustrating the spanner according to the fourth embodiment of the present invention.

FIG. 11 is a fragmentary exploded perspective view illustrating a spanner according to a fourth embodiment of the present invention, and FIG. 12 is a fragmentary plan view illustrating a state that the bolt head is inserted within the spanner of the fourth embodiment. As can be understood from these drawings, the fourth embodiment has a technical feature that it is provided with a protrusion (32) for gripping a bolt head modified from the aforementioned third embodiment, which is detachably mounted on the outer surface of the distal end of the first jaw (200) by a screw (31). This protrusion (32) may be, for example, a plate-type member having an end (32*a*) bent at preferably 120 degrees with respect to the inner surface of the first jaw to exactly fit to an angular portion of the bolt head. Also, this detachable protrusion (32) may be an elastic member, for example, a plate spring mechanism. The reference numeral 34 indicates a recess formed on the outer surface of the distal end of the first jaw for receiving the detachable protrusion (32) therein.

Figure 13:
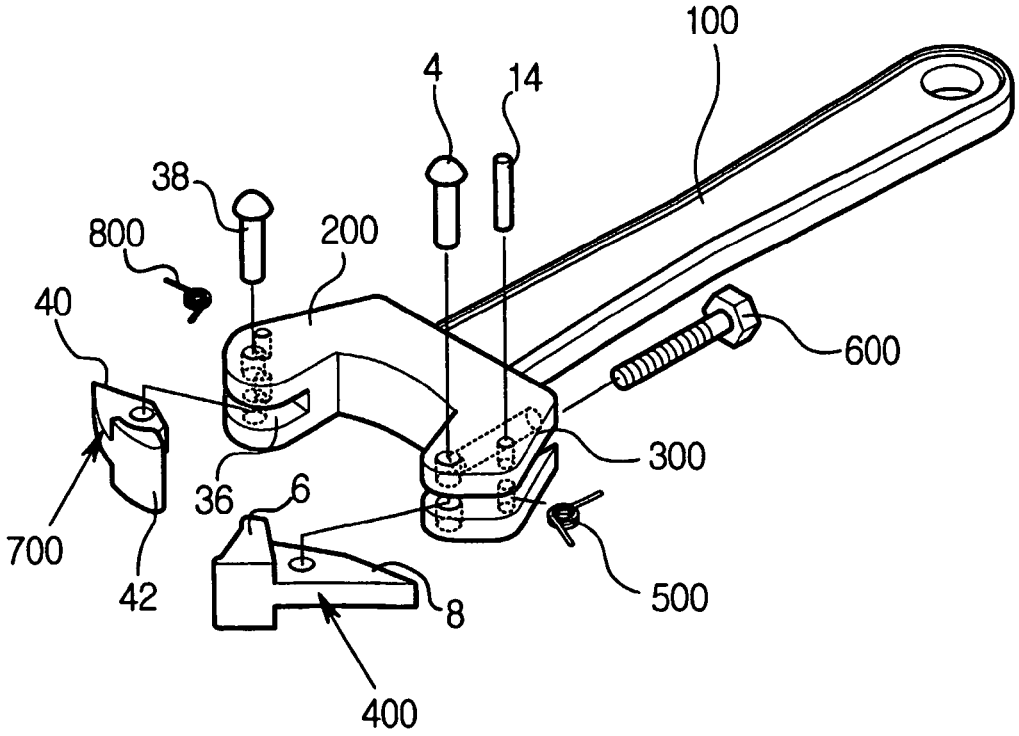
FIG. 13 is an exploded perspective view illustrating a spanner according to a fifth embodiment of the present invention.
Figure 14:
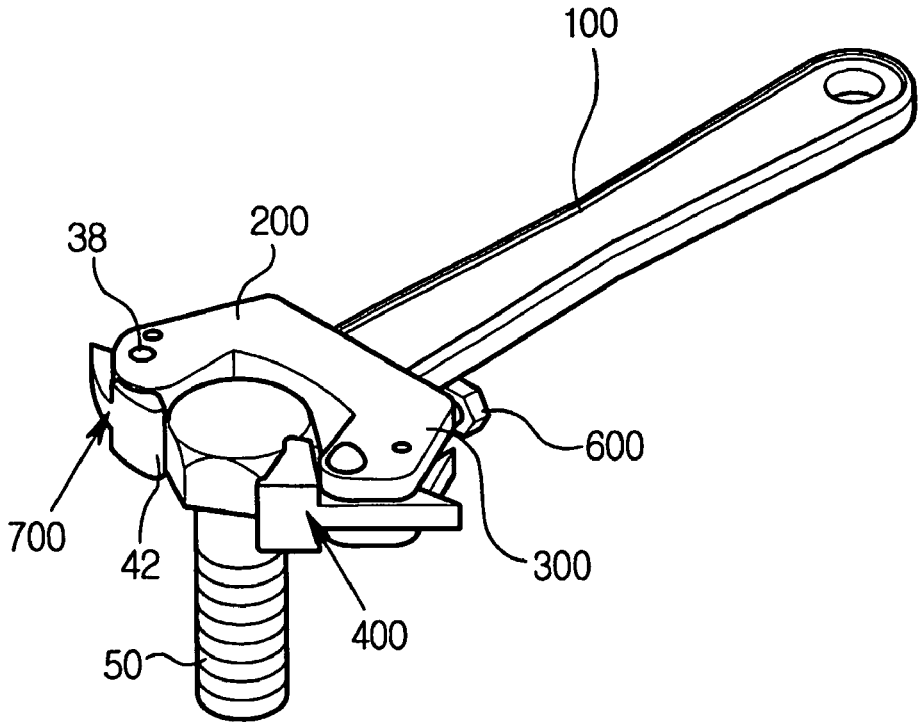
FIG. 14 is a perspective view illustrating a state that a bolt head is inserted within the spanner according to the fifth embodiment of the present invention.

FIGS. 13 and 14 are respectively an exploded perspective view of the spanner according to a fifth embodiment of the present invention and a perspective view illustrating a state that the bolt head is inserted within the spanner of the fifth embodiment. This embodiment has a feature that it is, as another modified protrusion, provided with an additional toggle bar (700) instead of those protrusions (30, 32) of the third and fourth embodiments.

According to the fifth embodiment of the present invention shown in FIGS. 13 and 14, a spanner comprises a lever (100), a first jaw (200) extending substantially longitudinally from an end of the lever and having a first recess (36) therein, a first toggle bar (700) pivotally mounted in the first recess by a pivot pin (38) and having an inner end portion (40) and an outer end portion (42), and an urging member (800) having one end supported by a wall of the first recess and the other end supporting the outer end portion of the first toggle bar for urging the first toggle bar to pivot toward its inner end portion, a second jaw (300) spaced apart from the first jaw (200) in a predetermined distance to form a pair of jaws and having a second recess (2) therein, a second toggle bar (400) pivotally mounted in the second recess by a pivot pin (4) and having an inner end portion (6) and an outer end portion (8), and a second urging member (500) having one end supported by a wall of the second recess and the other end supporting the outer end portion of the second toggle bar for urging the second toggle bar to pivot toward its inner end portion.

The construction for mounting the first toggle bar (700) on the first jaw (200) in the fifth embodiment is similar with the construction for mounting the second toggle bar (400) on the second jaw (300) in the first to fourth embodiments. The only difference is that, the toggle bar (400) in the first to fourth embodiments functions as a mechanical means for applying rotating force to the surface of the bolt head, whereas the first toggle bar (700) in the fifth embodiment functions merely as a gripping means for optionally gripping the bolt head.

Figure 15:
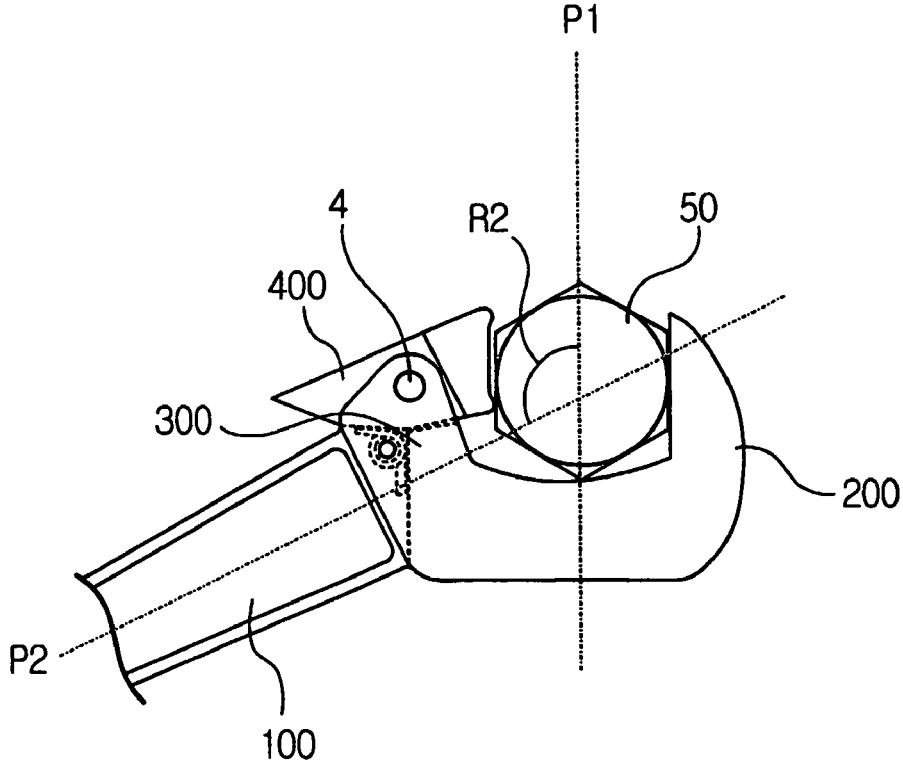
FIG. 15 is a fragmentary plan view exemplarily illustrating a spanner according to a sixth embodiment of the present invention provided with a lever extending in a direction not parallel with the longitudinal axis of two jaws.

FIG. 15 is a fragmentary plan view illustrating a spanner according to a sixth embodiment of the present invention, which has a feature that the longitudinal axis (P2) of the lever is not parallel with the longitudinal axis (P1) of two jaws and above two axis are disposed to define a predetermined angle with respect to each other. In the aforementioned first to fifth embodiments, the longitudinal axis of the lever substantially coincides with the longitudinal axis of two jaws, whereas in the sixth embodiment, the longitudinal axis of the lever is disposed to define a predetermined obtuse angle (R2) with respect to the longitudinal axis (P1) of two jaws, and the obtuse angle (R2) is in a range from 90 to 180 degrees.

According to the foregoing constructions, the present invention provides a spanner having a function of tightening or releasing a bolt continually in one direction by mounting a toggle bar having an extremely simple construction on a jaw of the spanner head, thereby it is possible to maintain its own merit of being convenient for operation in a slim working. space, in addition, this invention has advantages to make the rotating operation of the spanner to be easier by preventing the spanner head being readily disengaged from the bolt head.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A spanner comprising:

a lever;

a first jaw extending from an end of the lever;

a second jaw spaced from the first jaw in a predetermined distance to form a pair of jaws and having a recess therein;

a toggle bar pivotally mounted in the recess by a pivot pin and having an inner end portion and an outer end portion;

an urging member having one end supported by a wall of the recess and the other end supporting the outer end portion of the toggle bar for urging the toggle bar to pivot toward its inner end portion;

an adjustable stopper for adjusting the limit of pivoting angle of the toggle bar being urged to pivot toward its inner end portion;

wherein the adjustable stopper is a screw bolt mounted on the second jaw passing through the body of the second jaw so that an end of the screw bolt is in contact with the bottom surface of the inner end portion of the toggle bar, whereby the screw bolt can adjust the initial pivoting angle of the toggle bar.

2. A spanner according to claim 1, wherein the longitudinal axis of the lever is disposed to define an angle with respect to the longitudinal axis of two jaws in a range from 90 to 180 degrees.

3. A spanner according to claim 1, wherein the urging member includes a coil spring, a plate spring, a ball spring, or a plunger spring.

4. A spanner comprising:

a lever;

a first jaw extending from an end of the lever;

a second jaw spaced from the first jaw in a predetermined distance to form a pair of jaws and having a recess therein;

a toggle bar pivotally mounted in the recess by a pivot pin and having an inner end portion and an outer end portion;

an urging member having one end supported by a wall of the recess and the other end supporting the outer end portion of the toggle bar for urging the toggle bar to pivot toward its inner end portion;

further comprising a protrusion disposed on a distal end of the first jaw to define an angle of 120 degrees with respect to the inner surface of the first jaw.

5. A spanner according to the claim 4, wherein the protrusion is detachably mounted on a distal end of the first jaw by a screw.

6. A spanner comprising:

a lever, a first jaw extending longitudinally from an end of the lever and having a first recess therein, a first toggle bar pivotally mounted in the first recess by a pivot pin and having an inner end portion and an outer end portion, a first urging member having one end supported by a wall of the first recess and the other end supporting the outer end portion of the first toggle bar for urging the first toggle bar to pivot toward its inner end portion, a second jaw spaced apart from the first jaw in a predetermined distance to form a pair of jaws and having a second recess therein, a second toggle bar pivotally mounted in the second recess by a pivot pin and having an inner end portion and an outer end portion, and a second urging member having one end supported by a wall of the second recess and the other end supporting the outer end portion of the second toggle bar for urging the second toggle bar to pivot toward its inner portion.

* * * * *